US009091152B2

(12) United States Patent
Rodgers et al.

(10) Patent No.: US 9,091,152 B2
(45) Date of Patent: Jul. 28, 2015

(54) PERFORATING GUN WITH INTERNAL SHOCK MITIGATION

(75) Inventors: John P. Rodgers, Roanoke, TX (US); Timothy S. Glenn, Dracut, MA (US); Marco Serra, Winterthur (CH); Edwin A. Eaton, Grapevine, TX (US); John D. Burleson, Denton, TX (US); John H. Hales, Choctaw, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/493,327

(22) Filed: Jun. 11, 2012

(65) Prior Publication Data

US 2013/0048375 A1 Feb. 28, 2013

(51) Int. Cl.
*E21B 43/119* (2006.01)

(52) U.S. Cl.
CPC ..... *E21B 43/1195* (2013.01)

(58) Field of Classification Search
CPC ..... E21B 43/1195
USPC ..... 166/55.1; 175/4.54; 181/223
See application file for complete search history.

(56) References Cited

U.S. PATENT DOCUMENTS

| | | | | |
|---|---|---|---|---|
| 472,342 | A | 4/1892 | Draudt | |
| 1,073,850 | A | 9/1913 | Greer | |
| 2,440,452 | A | 4/1948 | Smith | |
| 2,797,892 | A * | 7/1957 | Ryan | 175/4.56 |
| 2,833,213 | A | 5/1958 | Udry | |
| 2,980,017 | A | 4/1961 | Castel | |
| 3,054,450 | A | 9/1962 | Baker | |
| 3,057,296 | A | 10/1962 | Silverman | |
| 3,128,825 | A | 4/1964 | Blagg | |
| 3,143,321 | A | 8/1964 | McGehee et al. | |
| 3,151,891 | A | 10/1964 | Sanders | |
| 3,208,378 | A | 9/1965 | Boop | |
| 3,216,751 | A | 11/1965 | Der Mott | |
| 3,381,983 | A | 5/1968 | Hanes | |
| 3,394,612 | A | 7/1968 | Bogosoff et al. | |

(Continued)

FOREIGN PATENT DOCUMENTS

| | | |
|---|---|---|
| EP | 2065557 A1 | 6/2009 |
| GB | 2406870 A | 4/2005 |

(Continued)

OTHER PUBLICATIONS

Office Action issued Apr. 21, 2011 for U.S. Appl. No. 13/008,075, 9 pages.

(Continued)

*Primary Examiner* — David Andrews
(74) *Attorney, Agent, or Firm* — Smith IP Services, P.C.

(57) ABSTRACT

A perforating gun can include at least one explosive component, and a shock mitigation device including a shock reflector which indirectly reflects a shock wave produced by detonation of the explosive component. Another perforating gun can include a gun housing, at least one explosive component, and a shock mitigation device in the gun housing. The shock mitigation device can include a shock attenuator which attenuates a shock wave produced by detonation of the explosive component. Yet another perforating gun can include a shock mitigation device with an explosive material which produces a shock wave that interacts with another shock wave produced by detonation of an explosive component in a gun housing.

9 Claims, 6 Drawing Sheets

(56) References Cited

U.S. PATENT DOCUMENTS

| | | | | |
|---|---|---|---|---|
| 3,414,071 | A | 12/1968 | Alberts | |
| 3,478,841 | A * | 11/1969 | Hubner | 181/223 |
| 3,653,468 | A | 4/1972 | Marshall | |
| 3,687,074 | A | 8/1972 | Andrews et al. | |
| 3,779,591 | A | 12/1973 | Rands | |
| 3,923,105 | A | 12/1975 | Lands, Jr. | |
| 3,923,106 | A | 12/1975 | Bosse-Platiere | |
| 3,923,107 | A | 12/1975 | Dillard | |
| 3,971,926 | A | 7/1976 | Gau et al. | |
| 4,269,063 | A | 5/1981 | Escaron et al. | |
| 4,319,526 | A | 3/1982 | Dermott | |
| 4,346,795 | A | 8/1982 | Herbert | |
| 4,409,824 | A | 10/1983 | Salama et al. | |
| 4,410,051 | A | 10/1983 | Daniel et al. | |
| 4,419,933 | A | 12/1983 | Kirby et al. | |
| 4,480,690 | A | 11/1984 | Vann | |
| 4,575,026 | A | 3/1986 | Brittain et al. | |
| 4,598,776 | A | 7/1986 | Stout | |
| 4,612,992 | A | 9/1986 | Vann et al. | |
| 4,619,333 | A | 10/1986 | George | |
| 4,637,478 | A | 1/1987 | George | |
| 4,679,669 | A | 7/1987 | Kalb et al. | |
| 4,685,708 | A | 8/1987 | Conner et al. | |
| 4,693,317 | A | 9/1987 | Edwards et al. | |
| 4,694,878 | A | 9/1987 | Gambertoglio | |
| 4,764,231 | A | 8/1988 | Slawinski et al. | |
| 4,817,710 | A | 4/1989 | Edwards et al. | |
| 4,830,120 | A | 5/1989 | Stout | |
| 4,842,059 | A | 6/1989 | Tomek | |
| 4,884,829 | A | 12/1989 | Funk et al. | |
| 4,901,802 | A | 2/1990 | George et al. | |
| 4,913,053 | A | 4/1990 | McPhee | |
| 4,971,153 | A | 11/1990 | Rowe et al. | |
| 5,027,708 | A | 7/1991 | Gonzalez et al. | |
| 5,044,437 | A | 9/1991 | Wittrisch | |
| 5,078,210 | A | 1/1992 | George | |
| 5,088,557 | A | 2/1992 | Ricles et al. | |
| 5,092,167 | A | 3/1992 | Finley et al. | |
| 5,103,912 | A | 4/1992 | Flint | |
| 5,107,927 | A | 4/1992 | Whiteley et al. | |
| 5,109,355 | A | 4/1992 | Yuno | |
| 5,117,911 | A | 6/1992 | Navarette et al. | |
| 5,131,470 | A | 7/1992 | Miszewski et al. | |
| 5,133,419 | A | 7/1992 | Barrington | |
| 5,161,616 | A | 11/1992 | Colla | |
| 5,188,191 | A | 2/1993 | Tomek | |
| 5,216,197 | A | 6/1993 | Huber et al. | |
| 5,287,924 | A | 2/1994 | Burleson et al. | |
| 5,341,880 | A | 8/1994 | Thorstensen et al. | |
| 5,343,963 | A | 9/1994 | Bouldin et al. | |
| 5,351,791 | A | 10/1994 | Rosenzweig | |
| 5,366,013 | A | 11/1994 | Edwards et al. | |
| 5,421,780 | A | 6/1995 | Vukovic | |
| 5,490,694 | A | 2/1996 | Shumway | |
| 5,529,127 | A | 6/1996 | Burleson et al. | |
| 5,547,148 | A | 8/1996 | Del Monte et al. | |
| 5,598,894 | A | 2/1997 | Burleson et al. | |
| 5,603,379 | A | 2/1997 | Henke et al. | |
| 5,662,166 | A | 9/1997 | Shammai | |
| 5,667,023 | A | 9/1997 | Harrell et al. | |
| 5,671,955 | A | 9/1997 | Shumway | |
| 5,774,420 | A | 6/1998 | Heysse et al. | |
| 5,813,480 | A | 9/1998 | Zaleski, Jr. et al. | |
| 5,823,266 | A | 10/1998 | Burleson et al. | |
| 5,826,654 | A | 10/1998 | Adnan et al. | |
| 5,868,200 | A | 2/1999 | Bryant et al. | |
| 5,957,209 | A | 9/1999 | Burleson et al. | |
| 5,964,294 | A | 10/1999 | Edwards et al. | |
| 5,992,523 | A | 11/1999 | Burleson et al. | |
| 6,012,015 | A | 1/2000 | Tubel | |
| 6,021,377 | A | 2/2000 | Dubinsky et al. | |
| 6,068,394 | A | 5/2000 | Dublin, Jr. | |
| 6,078,867 | A | 6/2000 | Plumb et al. | |
| 6,098,716 | A | 8/2000 | Hromas et al. | |
| 6,109,335 | A | 8/2000 | Jolivet et al. | |
| 6,135,252 | A | 10/2000 | Knotts | |
| 6,173,779 | B1 | 1/2001 | Smith | |
| 6,216,533 | B1 | 4/2001 | Woloson et al. | |
| 6,230,101 | B1 | 5/2001 | Wallis | |
| 6,283,214 | B1 | 9/2001 | Guinot et al. | |
| 6,308,809 | B1 | 10/2001 | Reid et al. | |
| 6,371,541 | B1 | 4/2002 | Pedersen | |
| 6,394,241 | B1 | 5/2002 | Desjardins et al. | |
| 6,397,752 | B1 | 6/2002 | Yang et al. | |
| 6,408,953 | B1 | 6/2002 | Goldman et al. | |
| 6,412,415 | B1 | 7/2002 | Kothari et al. | |
| 6,412,614 | B1 | 7/2002 | Lagrange et al. | |
| 6,450,022 | B1 | 9/2002 | Brewer | |
| 6,454,012 | B1 | 9/2002 | Reid | |
| 6,457,570 | B2 | 10/2002 | Reid et al. | |
| 6,484,801 | B2 | 11/2002 | Brewer et al. | |
| 6,543,538 | B2 | 4/2003 | Tolman et al. | |
| 6,550,322 | B2 | 4/2003 | Sweetland et al. | |
| 6,595,290 | B2 | 7/2003 | George et al. | |
| 6,672,405 | B2 | 1/2004 | Tolman et al. | |
| 6,674,432 | B2 | 1/2004 | Kennon et al. | |
| 6,679,323 | B2 | 1/2004 | Vargervik et al. | |
| 6,679,327 | B2 | 1/2004 | Sloan et al. | |
| 6,684,949 | B1 | 2/2004 | Gabler et al. | |
| 6,684,954 | B2 | 2/2004 | George | |
| 6,708,761 | B2 | 3/2004 | George et al. | |
| 6,752,207 | B2 | 6/2004 | Danos et al. | |
| 6,810,370 | B1 | 10/2004 | Watts, III | |
| 6,826,483 | B1 | 11/2004 | Anderson | |
| 6,832,159 | B2 | 12/2004 | Smits et al. | |
| 6,842,725 | B1 | 1/2005 | Sarda | |
| 6,868,920 | B2 | 3/2005 | Hoteit et al. | |
| 7,000,699 | B2 | 2/2006 | Yang et al. | |
| 7,006,959 | B1 | 2/2006 | Huh et al. | |
| 7,044,219 | B2 | 5/2006 | Mason et al. | |
| 7,114,564 | B2 | 10/2006 | Parrott et al. | |
| 7,121,340 | B2 | 10/2006 | Grove et al. | |
| 7,139,689 | B2 | 11/2006 | Huang | |
| 7,147,088 | B2 | 12/2006 | Reid et al. | |
| 7,165,612 | B2 | 1/2007 | McLaughlin | |
| 7,178,608 | B2 | 2/2007 | Mayes et al. | |
| 7,195,066 | B2 | 3/2007 | Sukup et al. | |
| 7,234,517 | B2 | 6/2007 | Streich et al. | |
| 7,246,659 | B2 | 7/2007 | Fripp et al. | |
| 7,260,508 | B2 | 8/2007 | Lim et al. | |
| 7,278,480 | B2 | 10/2007 | Longfield et al. | |
| 7,308,967 | B1 * | 12/2007 | Hoel | 181/223 |
| 7,387,160 | B2 | 6/2008 | O'Shaughnessy et al. | |
| 7,387,162 | B2 | 6/2008 | Mooney, Jr. et al. | |
| 7,393,019 | B2 | 7/2008 | Taga et al. | |
| 7,503,403 | B2 | 3/2009 | Jogi et al. | |
| 7,509,245 | B2 | 3/2009 | Siebrits et al. | |
| 7,533,722 | B2 | 5/2009 | George et al. | |
| 7,600,568 | B2 | 10/2009 | Ross et al. | |
| 7,603,264 | B2 | 10/2009 | Zamora et al. | |
| 7,640,986 | B2 | 1/2010 | Behrmann et al. | |
| 7,699,356 | B2 | 4/2010 | Bucher et al. | |
| 7,721,650 | B2 | 5/2010 | Barton et al. | |
| 7,721,820 | B2 | 5/2010 | Hill et al. | |
| 7,722,089 | B2 | 5/2010 | Nauer | |
| 7,762,331 | B2 | 7/2010 | Goodman et al. | |
| 7,770,662 | B2 | 8/2010 | Harvey et al. | |
| 7,806,035 | B2 | 10/2010 | Kaiser et al. | |
| 7,954,860 | B2 | 6/2011 | Suzuki | |
| 8,126,646 | B2 | 2/2012 | Grove et al. | |
| 8,136,608 | B2 | 3/2012 | Goodman | |
| 2002/0121134 | A1 | 9/2002 | Sweetland et al. | |
| 2002/0189809 | A1 | 12/2002 | Nguyen et al. | |
| 2003/0000699 | A1 | 1/2003 | Hailey, Jr. | |
| 2003/0062169 | A1 | 4/2003 | Marshall | |
| 2003/0089497 | A1 | 5/2003 | George et al. | |
| 2003/0150646 | A1 | 8/2003 | Brooks et al. | |
| 2004/0045351 | A1 | 3/2004 | Skinner | |
| 2004/0104029 | A1 | 6/2004 | Martin | |
| 2004/0140090 | A1 | 7/2004 | Mason et al. | |
| 2006/0048940 | A1 | 3/2006 | Hromas et al. | |
| 2006/0070734 | A1 | 4/2006 | Zillinger et al. | |
| 2006/0118297 | A1 | 6/2006 | Finci et al. | |
| 2006/0243453 | A1 | 11/2006 | McKee | |

(56) References Cited

U.S. PATENT DOCUMENTS

| | | | |
|---|---|---|---|
| 2007/0101808 | A1 | 5/2007 | Irani et al. |
| 2007/0162235 | A1 | 7/2007 | Zhan et al. |
| 2007/0193740 | A1 | 8/2007 | Quint |
| 2007/0214990 | A1 | 9/2007 | Barkley et al. |
| 2007/0283751 | A1 | 12/2007 | Van Der Spek |
| 2008/0041597 | A1 | 2/2008 | Fisher et al. |
| 2008/0149338 | A1 | 6/2008 | Goodman et al. |
| 2008/0202325 | A1 | 8/2008 | Bertoja et al. |
| 2008/0216554 | A1 | 9/2008 | McKee |
| 2008/0245255 | A1 | 10/2008 | Barton et al. |
| 2008/0262810 | A1 | 10/2008 | Moran et al. |
| 2008/0314582 | A1 | 12/2008 | Belani et al. |
| 2009/0013775 | A1 | 1/2009 | Bogath et al. |
| 2009/0071645 | A1 | 3/2009 | Kenison et al. |
| 2009/0084535 | A1 | 4/2009 | Bertoja et al. |
| 2009/0151589 | A1 | 6/2009 | Henderson et al. |
| 2009/0159284 | A1 | 6/2009 | Goodman |
| 2009/0168606 | A1 | 7/2009 | Lerche et al. |
| 2009/0182541 | A1 | 7/2009 | Crick et al. |
| 2009/0223400 | A1 | 9/2009 | Hill et al. |
| 2009/0241658 | A1 | 10/2009 | Irani et al. |
| 2009/0272529 | A1 | 11/2009 | Crawford |
| 2009/0276156 | A1 | 11/2009 | Kragas et al. |
| 2009/0294122 | A1 | 12/2009 | Hansen et al. |
| 2010/0000789 | A1 | 1/2010 | Barton et al. |
| 2010/0011943 | A1 | 1/2010 | Quinn et al. |
| 2010/0037793 | A1 | 2/2010 | Lee et al. |
| 2010/0051265 | A1 | 3/2010 | Hurst et al. |
| 2010/0085210 | A1 | 4/2010 | Bonavides et al. |
| 2010/0132939 | A1 | 6/2010 | Rodgers |
| 2010/0133004 | A1 | 6/2010 | Burleson et al. |
| 2010/0147519 | A1 | 6/2010 | Goodman |
| 2010/0230105 | A1 | 9/2010 | Vaynshteyn |
| 2012/0085539 | A1 | 4/2012 | Tonnessen et al. |
| 2012/0152519 | A1 | 6/2012 | Rodgers et al. |
| 2012/0152542 | A1 | 6/2012 | Le |
| 2012/0152614 | A1 | 6/2012 | Rodgers et al. |
| 2012/0152615 | A1 | 6/2012 | Rodgers et al. |
| 2012/0152616 | A1 | 6/2012 | Rodgers et al. |
| 2012/0158388 | A1 | 6/2012 | Rodgers et al. |
| 2012/0181026 | A1 | 7/2012 | Le et al. |

FOREIGN PATENT DOCUMENTS

| | | | |
|---|---|---|---|
| WO | 2004076813 | A1 | 9/2004 |
| WO | 2004099564 | A2 | 11/2004 |
| WO | 2007056121 | A1 | 5/2007 |

OTHER PUBLICATIONS

International Search Report with Written Opinion issued Jul. 28, 2011 for International Application No. PCT/US10/61104, 8 pages.
International Search Report with Written Opinion issued Jul. 28, 2011 for International Application No. PCT/US10/61102, 8 pages.
Office Action issued Jun. 6, 2012 for U.S. Appl. No. 13/325,909, 35 pages.
IES, Scott A. Ager; "IES Housing and High Shock Considerations", informational presentation, 18 pages.
IES, Scott A. Ager; Analog Recorder Test Example, informational letter, dated Sep. 1, 2010, 1 page.
IES, Scott A. Ager; "Series 300 Gauge", product information, dated Sep. 1, 2010, 1 page.
IES, Scott A. Ager; "IES Introduction", Company introduction presentation, 23 pages.
Petroleum Experts; "IPM: Engineering Software Development", product brochure, dated 2008, 27 pages.
International Search Report with Written Opinion issued Oct. 27, 2011 for PCT Patent Application No. PCT/US11/034690, 9 pages.
Kappa Engineering; "Petroleum Exploration and Product Software, Training and Consulting", product informational paper on v4.12B, dated Jan. 2010, 48 pages.
Qiankun Jin, Zheng Shigui, Gary Ding, Yianjun, Cui Binggui, Beijing Engeneering Software Technology Co. Ltd.; "3D Numerical Simulations of Penetration of Oil-Well Perforator into Concrete Targets", Paper for the 7th International LS-DYNA Users Conference, 6 pages.
Mario Dobrilovic, Zvonimir Ester, Trpimir Kujundzic; "Measurements of Shock Wave Force in Shock Tube with Indirect Methods", Original scientific paper vol. 17, str. 55-60, dated 2005, 6 pages.
IES, Scott A. Ager; "Model 64 and 74 Buildup", product presentation, dated Oct. 17, 2006,57 pages.
A. Blakeborough et al.; "Novel Load Cell for Measuring Axial Forca, Shear Force, and Bending Movement in large-scale Structural Experiments", Informational paper, dated Mar. 23-Aug. 30, 2001, 8 pages.
Weibing Li et al.; "The Effect of Annular Multi-Point Initiation on the Formation and Penetration of an Explosively Formed Penetrator", Article in the International Journal of Impact Engineering, dated Aug. 27, 2009, 11 pages.
Sergio Murilo et al.; "Optimization and Automation of Modeling of Flow Perforated Oil Wells", Presentation for the Product Development Conference, dated 2004, 31 pages.
Frederic Bruyere et al.; "New Practices to Enhance Perforating Results", Oilfield Review, dated Autumn 2006, 18 pages.
John F. Schatz; "Perf Breakdown, Fracturing, and Cleanup in PulsFrac", informational brochure, dated May 2, 2007, 6 pages.
M. A. Proett et al.; "Productivity Optimization of Oil Wells Using a New 3D Finite-Element Wellbore Inflow Model and Artificial Neutral Network", conference paper, dated 2004, 17 pages.
John F. Schatz; "PulsFrac Summary Technical Description", informational brochure, dated 2003, 8 pages.
IES, Scott A. Ager; "IES Recorder Buildup", Company presentation, 59 pages.
IES, Scott A. Ager; "IES Sensor Discussion", 38 pages.
IES; "Series 300: High Shock, High Speed Pressure Gauge", product brochure, dated Feb. 1, 2012, 2 pages.
Specification and drawing for U.S. Appl. No. 13/413,588, filed Mar. 6, 2012, 30 pages.
Scott A. Ager; "IES Fast Speed Gauges", informational presentation, dated Mar. 2, 2009, 38 pages.
IES; "Battery Packing for High Shock", article AN102, 4 pages.
IES; "Accelerometer Wire Termination", article AN106, 4 pages.
John F. Schatz; "PulsFrac Validation: Owen/HTH Surface Block Test", product information, dated 2004, 4 pages.
Offshore Technology Conference; "Predicting Pressure Behavior and Dynamic Shock Loads on Completion Hardware During Perforating", OTC 21059, dated May 3-6, 2010, 11 pages.
IES; "Series 200: High Shock, High Speed Pressure and Acceleration Gauge", product brochure, 2 pages.
Terje Rudshaug, et al.; "A toolbox for improved Reservoir Management", NETool, FORCE AWTC Seminar, Apr. 21-22, 2004, 29 pages.
Halliburton; "ShockPro Schockload Evaluation Service", Perforating Solutions pp. 5-125 to 5-126, dated 2007, 2 pages.
Halliburton; "ShockPro Schockload Evaluation Service", H03888, dated Jul. 2007, 2 pages.
Strain Gages; "Positioning Strain Gages to Monitor Bending, Axial, Shear, and Torsional Loads", pp. E-5 to E-6, dated 2012, 2 pages.
B. Grove, et al.; "Explosion-Induced Damage to Oilwell Perforating Gun Carriers", Structures Under Shock and Impact IX, vol. 87, ISSN 1743-3509, SU060171, dated 2006, 12 pages.
WEM; "Well Evaluation Model", product brochure, 2 pages.
ENDEVCO; "Problems in High-Shock Measurement", MEGGITT brochure TP308, dated Jul. 2007, 9 pages.
John F. Schatz; "Casing Differential in PulsFrac Calculations", product information, dated 2004, 2 pages.
John F. Schatz; "The Role of Compressibility in PulsFrac Software", informational paper, dated Aug. 22, 2007, 2 pages.
"2010 International Perforating Symposium", Agenda, dated May 6-7, 2010, 2 pages.
ESSCA Group; "Erin Dynamic Flow Analysis Platform", online article, dated 2009, 1 page.
Halliburton; "Fast Gauge Recorder", article 5-110, 2 pages.
Kenji Furui; "A Comprehensive Skin Factor Model for Well Completions Based on Finite Element Simulations", informational paper, dated May 2004, 182 pages.

(56) References Cited

OTHER PUBLICATIONS

Halliburton; "Simulation Software for EquiFlow ICD Completions", H07010, dated Sep. 2009, 2 pages.
Specification and drawing for U.S. Appl. No. 13/377,148, filed Dec. 8, 2011, 47 pages.
International Search Report with Written Opinion issued Nov. 30, 2011 for PCT/US11/036686, 10 pages.
Office Action issued Sep. 6, 2012 for U.S. Appl. No. 13/495,035, 28 pages.
Specification and drawing for U.S. Appl. No. 13/585,846, filed Aug. 25, 2012, 45 pages.
Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued May 4, 2011, for U.S. Appl. No. 11/957,541, 9 pages.
Office Action issued Apr. 21, 2011, for U.S. Appl. No. 13/008,075, 9 pages.
J.A. Regalbuto et al; "Computer Codes for Oilwell-Perforator Design", SPE 30182, dated Sep. 1997, 8 pages.
J.F. Schatz et al; "High-Speed Downhole Memory Recorder and Software Used to Design and Confirm Perforating/Propellant Behavior and Formation Fracturing", SPE 56434, dated Oct. 3-6, 1999, 9 pages.
Joseph Ansah et al; "Advances in Well Completion Design: A New 3D Finite-Element Wellbore Inflow Model for Optimizing Performance of Perforated Completions", SPE 73760, Feb. 20-21, 2002, 11 pages.
D.A. Cuthill et al; "A New Technique for Rapid Estimation of Fracture Closure Stress When Using Propellants", SPE 78171, dated Oct. 20-23, 2002, 6 pages.
J.F. Schatz et al; "High-Speed Pressure and Accelerometer Measurements Characterize Dynamic Behavior During Perforating Events in Deepwater Gulf of Mexico", SPE 90042, dated Sep. 26-29, 2004, 15 pages.
Liang-Biao Ouyang et al; "Case Studies for Improving Completion Design Through Comprehensive Well-Performance Modeling", SPE 104078, dated Dec. 5-7, 2006, 11 pages.
Liang-Biao Ouyang et al; "Uncertainty Assessment on Well-Performance Prediction for an Oil Producer Equipped With Selected Completions", SPE 106966, dated Mar. 31-Apr. 3, 2007, 9 pages.
B. Grove et al; "new Effective Stress Law for Predicting Perforation Depth at Downhole Conditions", SPE 111778, dated Feb. 13-15, 2008, 10 pages.
Office Action issued Oct. 1, 2012 for U.S. Appl. No. 13/325,726, 20 pages.
International Search Report with Written Opinion issued Mar. 22, 2011 for PCT Patent Application No. PCT/US11/029412, 9 pages.
International Search Report with Written Opinion issued Sep. 2, 2011 for PCT Patent Application No. PCT/US11/050395, 9 pages.
International Search Report with Written Opinion issued Aug. 31, 2011 for PCT Patent Application No. PCT/US11/049882, 9 pages.
Office Action issued Feb. 24, 2012 for U.S. Appl. No. 13/304,075, 15 pages.
Office Action issued Apr. 10, 2012 for U.S. Appl. No. 13/325,726, 26 pages.
Office Action issued Jul. 12, 2012 for U.S. Appl. No. 13/413,588, 42 pages.
Office Action issued Jul. 26, 2012 for U.S. Appl. No. 13/325,726, 52 pages.
Office Action issued Aug. 2, 2012 for U.S. Appl. No. 13/210,303, 35 pages.
Australian Office Action issued Sep. 21, 2012 for AU Patent Application No. 2010365400, 3 pages.
Office Action issued Oct. 23, 2012 for U.S. Appl. No. 13/325,866, 35 pages.
Halliburton; "AutoLatch Release Gun Connector", Special Applications 6-7, 1 page.
Halliburton; "Body Lock Ring", Mechanical Downhole: Technology Transfer, dated Oct. 10, 2001, 4 pages.
Office Action issued Jun. 13, 2012 for U.S. Appl. No. 13/377,148, 38 pages.
Carlos Baumann, Harvey Williams, and Schlumberger; "Perforating Wellbore Dynamics and Gunshock in Deepwater TCP Operations", Product informational presentation, IPS-10-018, 28 pages.
Schlumberger; "SXVA Explosively Initiated Vertical Shock Absorber", product paper 06-WT-066, dated 2007, 1 page.
International Search Report with Written Opinion issued Dec. 27, 2011 for PCT Patent Application No. PCT/US11/046955, 8 pages.
International Search Report with Written Opinion issued Nov. 22, 2011 for International Application No. PCT/US11/029412, 9 pages.
International Search Report with Written Opinion issued Jul. 28, 2011 for International Application No. PCT/US10/061107, 9 pages.
International Search Report with Written Opinion issued Oct. 27, 2011 for International Application No. PCT/US11/034690, 9 pages.
Specification and drawing for U.S. Appl. No. 13/304,075, filed Nov. 23, 2011, 32 pages.
Specification and drawing for U.S. Appl. No. 13/314,853, filed Dec. 8, 2011, 40 pages.
Office Action issued May 4, 2011 for U.S. Appl. No. 11/957,541, 9 pages.
Specification and drawing for U.S. Appl. No. 13/078,423, filed Apr. 1, 2011, 42 pages.
Search Report issued Feb. 20, 2012 for International Application No. PCT/US11/49882, 5 pages.
Written Opinion issued Feb. 20, 2012 for International Application No. PCT/US11/49882, 4 pages.
Office Action issued Jan. 27, 2012 for U.S. Appl. No. 13/210,303, 32 pages.
Office Action issued Jun. 7, 2012 for U.S. Appl. No. 13/430,550, 21 pages.
Office Action issued Mar. 21, 2013 for U.S. Appl. No. 13/413,588, 14 pages.
Office Action issued Mar. 21, 2013 for U.S. Appl. No. 13/430,550, 17 pages.
International Search Report with Written Opinion issued Feb. 9, 2012 for PCT Patent Application No. PCT/US11/050401, 8 pages.
Special Devices, Inc.; "Electronic Initiation System: The SDI Electronic Initiation System", online product brochure from www.specialdevices.com, 4 pages.
Joseph E. Shepherd; "Structural Response of Piping to Internal Gas Detonation", article PVP2006-ICPVT11-93670, proceedings of PVP2006-ICPVT-11, dated 2006, 18 pages.
Office Action issued Nov. 19, 2012 for U.S. Appl. No. 13/325,909, 43 pages.
Office Action issued Dec. 14, 2012 for U.S. Appl. No. 13/495,035, 19 pages.
Office Action issued Dec. 18, 2012 for U.S. Appl. No. 13/533,600, 48 pages.
Australian Examination Report issued Jan. 3, 2013 for AU Patent Application No. 2010365400, 3 pages.
Office Action issued Jan. 28, 2013 for U.S. Appl. No. 13/413,588, 44 pages.
Office Action issued Jan. 29, 2013 for U.S. Appl. No. 13/430,550, 55 pages.
Office Action issued Feb. 12, 2013 for U.S. Appl. No. 13/633,077, 31 pages.
Office Action issued Jul. 15, 2013 for U.S. Appl. No. 13/848,632, 43 pages.
Office Action issued Jul. 17, 2013 for U.S. Appl. No. 13/430,550, 22 pages.
Office Action issued Jul. 18, for U.S. Appl. No. 13/413,588, 17 pages.
Advisory Action issued Nov. 27, 2013 for U.S. Appl. No. 13/210,303, 3 pages.
Office Action issued Sep. 13, 2013 for U.S. Appl. No. 13/210,303, 25 pages.

(56) References Cited

OTHER PUBLICATIONS

Mexican Office Action issued Sep. 2, 2013 for Mexican Patent Application No. MX/a/2011/011468, 3 pages.
Office Action issued Jun. 20, 2013 for U.S. Appl. No. 13/533,600, 38 pages.
Office Action issued Mar. 12, 2014 for U.S. Appl. No. 13/304,075, 17 pages.
Office Action issued Mar. 21, 2014 for U.S. Appl. No. 14/104,130, 19 pages.
Office Action issued Nov. 7, 2013 for U.S. Appl. No. 13/304,075, 104 pages.
Office Action issued Jul. 3, 2014 for U.S. Appl. No. 13/210,303, 23 pages.
Office Action issued Nov. 26, 2014 for U.S. Appl. No. 13/533,600, 5 pages.

* cited by examiner

PERFORATING GUN WITH INTERNAL SHOCK MITIGATION

CROSS-REFERENCE TO RELATED APPLICATION

This application claims the benefit under 35 USC §119 of the filing date of International Application Serial No. PCT/US11/49882 filed 31 Aug. 2011. The entire disclosure of this prior application is incorporated herein by this reference.

BACKGROUND

The present disclosure relates generally to equipment utilized and operations performed in conjunction with a subterranean well and, in an embodiment described herein, more particularly provides for mitigating shock produced by well perforating.

Shock absorbers have been used in the past to absorb shock produced by detonation of perforating guns in wells. Unfortunately, prior shock absorbers have had only very limited success. Therefore, it will be appreciated that improvements are needed in the art of mitigating shock produced by perforating strings.

SUMMARY

In carrying out the principles of this disclosure, a perforating gun is provided with improvements in the art. One example is described below in which a shock mitigation device in a perforating gun reflects shock produced by detonation of the perforating gun. Another example is described below in which the shock mitigation device attenuates the shock. Yet another example is described in which the device produces a shock wave that interacts with a shock wave produced by detonation of the perforating gun.

In one aspect, a perforating gun is provided to the art by this disclosure. In one example, the perforating gun can include at least one explosive component, and a shock mitigation device with a shock reflector which indirectly reflects a shock wave produced by detonation of the explosive component.

In another aspect, a perforating gun is described below which, in one example, can include a gun housing, at least one explosive component, and a shock mitigation device in the gun housing. The shock mitigation device includes a shock attenuator which attenuates a shock wave produced by detonation of the explosive component.

In yet another aspect, the disclosure below describes a perforating gun in which a shock mitigation device includes an explosive material which produces a shock wave that interacts with another shock wave produced by detonation of an explosive component in a gun housing.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
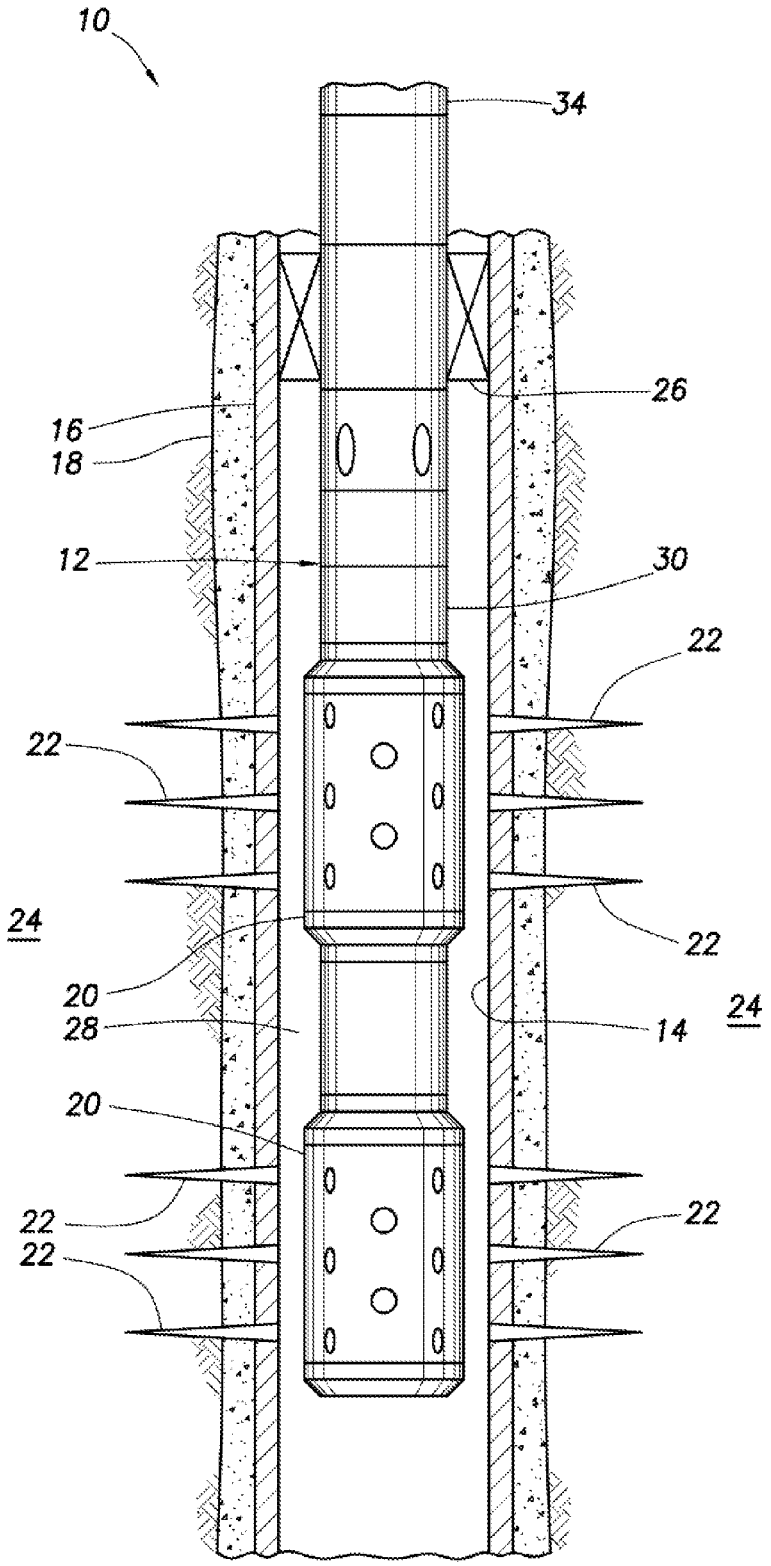
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. In the system 10, a perforating string 12 is positioned in a wellbore 14 lined with casing 16 and cement 18. Perforating guns 20 in the perforating string 12 are positioned opposite predetermined locations for forming perforations 22 through the casing 16 and cement 18, and outward into an earth formation 24 surrounding the wellbore 14.

The perforating string 12 is sealed and secured in the casing 16 by a packer 26. The packer 26 seals off an annulus 28 formed radially between the tubular string 12 and the wellbore 14. A tubular string 34 (such as a work string, a production tubing string, an injection string, etc.) may be interconnected above the packer 26.

A firing head 30 is used to initiate firing or detonation of the perforating guns 20 (e.g., in response to a mechanical, hydraulic, electrical, optical or other type of signal, passage of time, etc.), when it is desired to form the perforations 22. Although the firing head 30 is depicted in FIG. 1 as being connected above the perforating guns 20, one or more firing heads may be interconnected in the perforating string 12 at any location, with the location(s) preferably being connected to the perforating guns by a detonation train.

At this point, it should be noted that the well system 10 of FIG. 1 is merely one example of an unlimited variety of different well systems which can embody principles of this disclosure. Thus, the scope of this disclosure is not limited at all to the details of the well system 10, its associated methods, the perforating string 12, etc. described herein or depicted in the drawings.

For example, it is not necessary for the wellbore 14 to be vertical, for there to be two of the perforating guns 20, or for the firing head 30 to be positioned between the perforating guns and the packer 26, etc. Instead, the well system 10 configuration of FIG. 1 is intended merely to illustrate how the principles of this disclosure may be applied to an example perforating string 12, in order to mitigate the effects of a perforating event. These principles can be applied to many other examples of well systems and perforating strings, while remaining within the scope of this disclosure.

It will be appreciated by those skilled in the art that detonation of the perforating guns 20 produces shock which can damage or unset the packer 26, or damage the tubular string 34, firing head 30 or other components of the perforating string 12. In the past, it has been common practice to attempt to absorb shock produced by detonation of perforating guns, using shock absorbers interconnected between components of perforating strings.

In contrast, the present inventors have conceived unique ways of mitigating shock that do not involve the use of shock absorbers between components of a perforating string. Of course, shock absorbers could be used in combination with the concepts described herein, while remaining within the scope of this disclosure.

Figure 2:
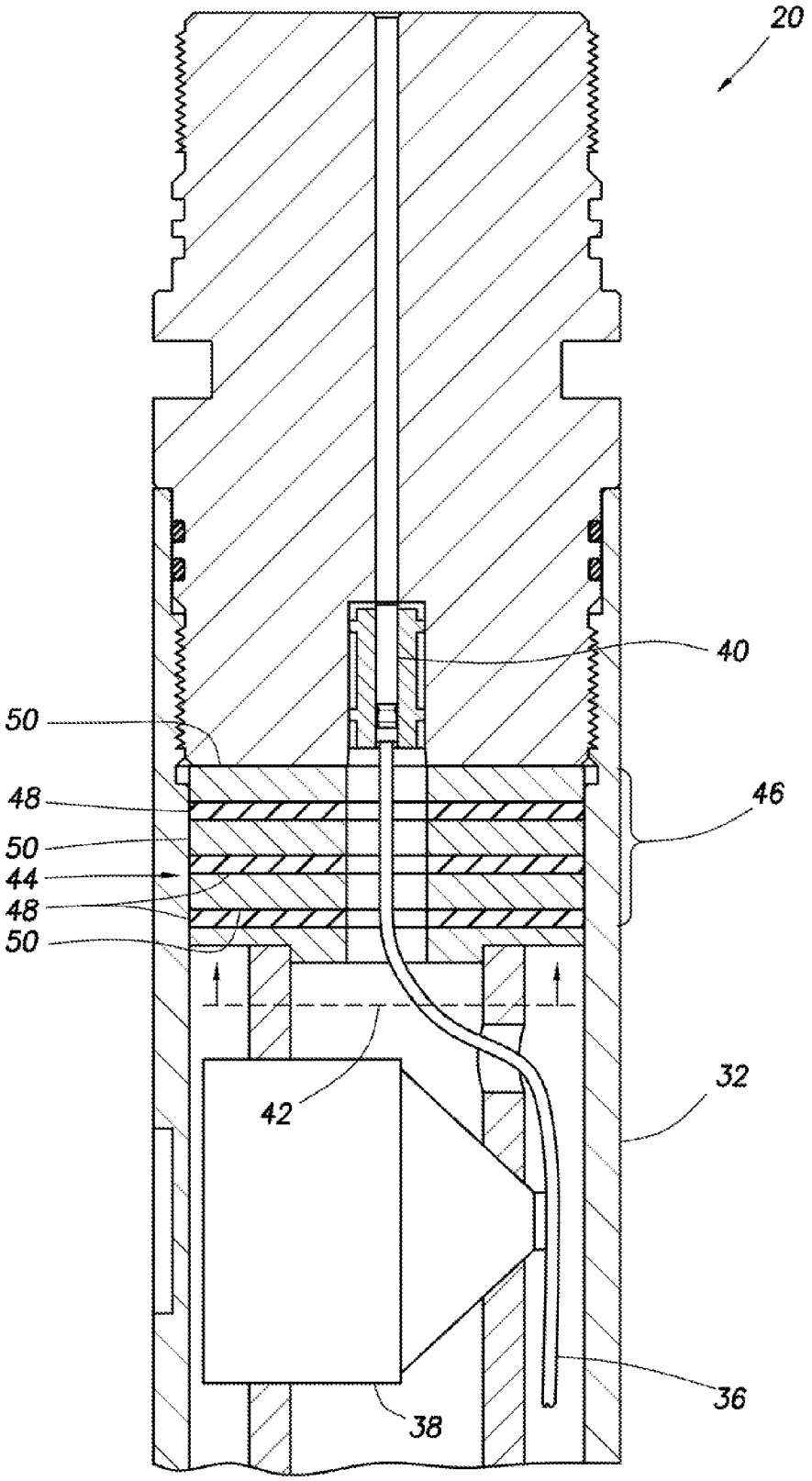
FIG. 2 is a representative cross-sectional view of a perforating gun which may be used in the system and method of FIG. 1, and which can embody principles of this disclosure.

Referring additionally now to FIG. 2, an enlarged scale cross-sectional view of a portion of one of the perforating guns 20 is representatively illustrated. This perforating gun 20 example may be used in the well system 10 and method described above, or it may be used in other well systems and methods.

As depicted in FIG. 2, the perforating gun 20 includes a generally tubular gun housing 32 and explosive components (such as detonating cord 36, perforating charges 38, detonation boosters 40, etc.) in the gun housing. When the explosive components are detonated (e.g., to form the perforations 22), shock waves 42 are produced. For clarity of illustration, only one of the shock waves 42 is representatively depicted as a dashed line in FIG. 2.

To mitigate transmission of the shock wave 42 to other components of a perforating string, the perforating gun 20 also includes a shock mitigating device 44. In this example, the shock mitigating device 44 is enclosed within the gun housing 32 and functions to mitigate shock prior to the shock reaching any other components of the perforating string. One advantage of this arrangement is that such shock mitigating devices 44 can be used in each of multiple perforating guns in a perforating string, so that the shock produced by each perforating gun is internally mitigated.

In the FIG. 2 example, the device 44 includes a shock attenuator 46 which attenuates the shock wave 42. The attenuator 46 includes alternating layers of resilient material 48 (e.g., elastomers, rubber, fluoro-elastomers, etc.) and non-resilient material 50 (e.g., soft metals such as aluminum, bronze, etc., crushable materials, etc.).

The attenuator 46 desirably decreases the amplitude of the shock wave 42. However, other types of shock attenuators may be used, if desired.

Preferably, the attenuator 46 provides sharply varying acoustic impendances (e.g., due to the layers of resilient and non-resilient materials 48, 50). For example, density, modulus, and/or other characteristics of materials can affect their acoustic impendances. By varying these characteristics from one layer to another, corresponding varying acoustic impendances are obtained (e.g., alternating layers of metal and poly-ether-ether-ketone, etc.). Thus, the attenuator 46 can be constructed without alternating layers of materials 48, 50 which are necessarily resilient and non-resilient, but which have substantially different acoustic impedances.

Figure 3:
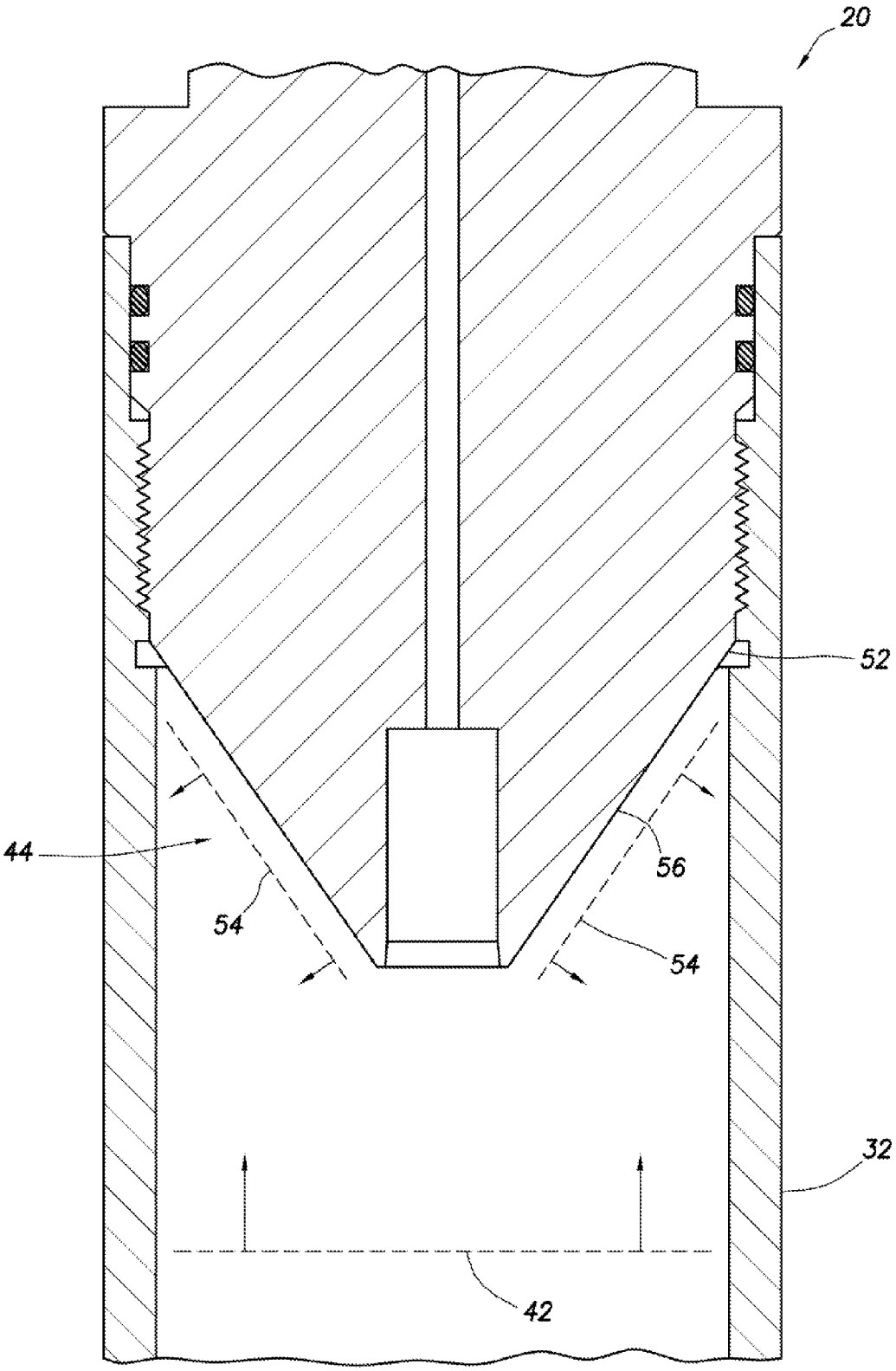
FIGS. 3-6 are representative cross-sectional views of additional configurations of a shock mitigating device in the perforating gun.

Referring additionally now to FIG. 3, the perforating gun 20, with another configuration of the shock mitigating device 44, is representatively illustrated. The explosive components are not depicted in FIG. 3 for clarity of illustration.

In this example, the shock mitigating device 44 includes a shock reflector 52 which reflects the shock wave 42 produced by detonation of the explosive components. Preferably, the reflected shock wave(s) 54 are not reflected directly back in a direction opposite to the direction of the shock wave 42. Instead, the shock wave 42 is reflected outward by a convex generally conical surface 56 of the reflector 52. In other examples, the surface 56 is not necessarily convex or conical, but preferably the surface does indirectly reflect the shock wave 42.

Figure 4:
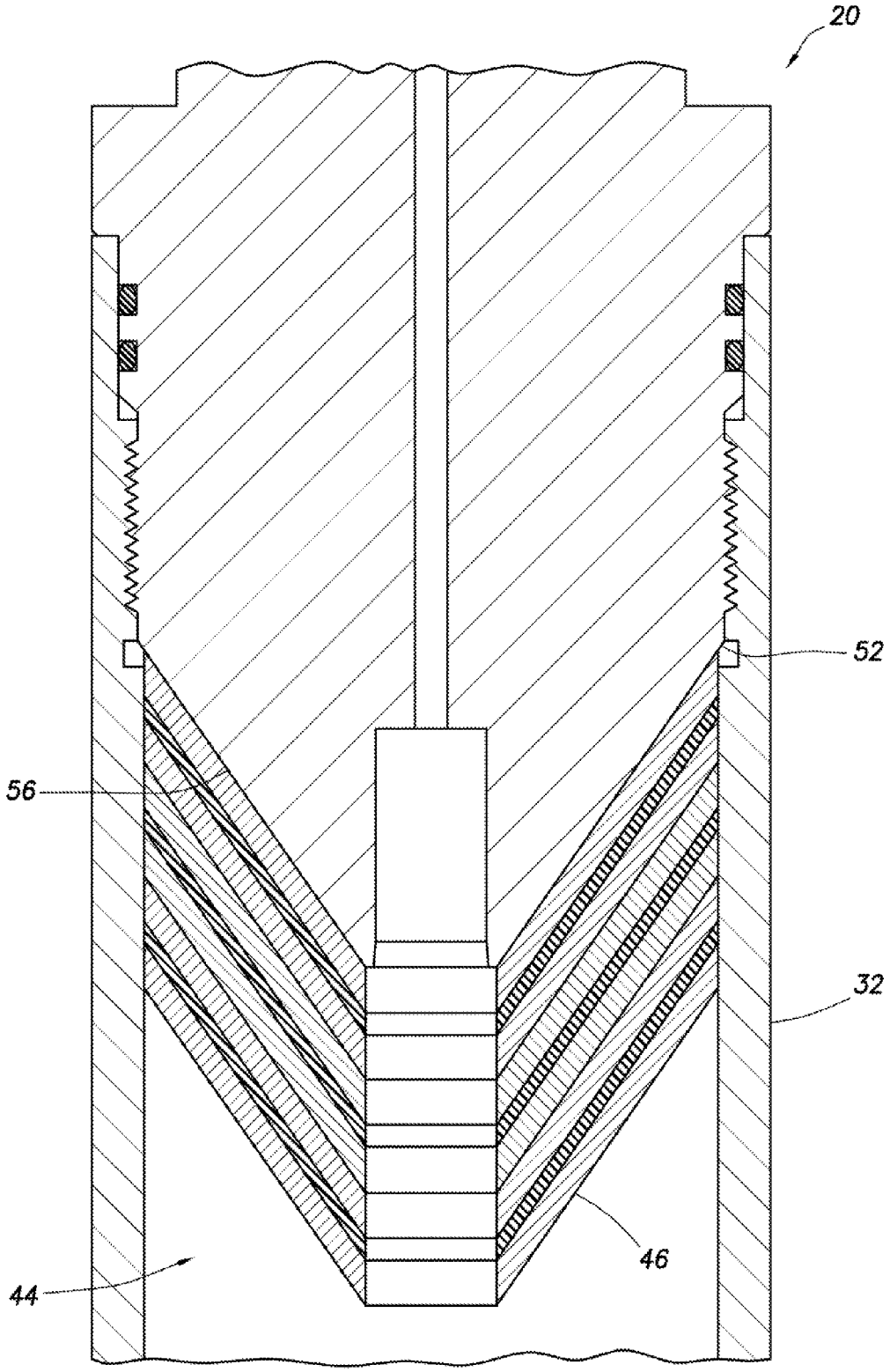

Referring additionally now to FIG. 4, another configuration of the shock mitigating device 44 is representatively illustrated. In this example, the shock mitigating device 44 includes both the reflector 52 of FIG. 3 and the attenuator 46 of FIG. 2 (albeit formed into a generally conical shape).

This demonstrates that the features of the various examples described herein can be combined as desired, for example, to obtain benefits of those combined features. In the FIG. 4 example, the shock wave 42 will be attenuated by the attenuator 46 prior to being reflected by the surface 56 of the reflector 52.

Figure 5:
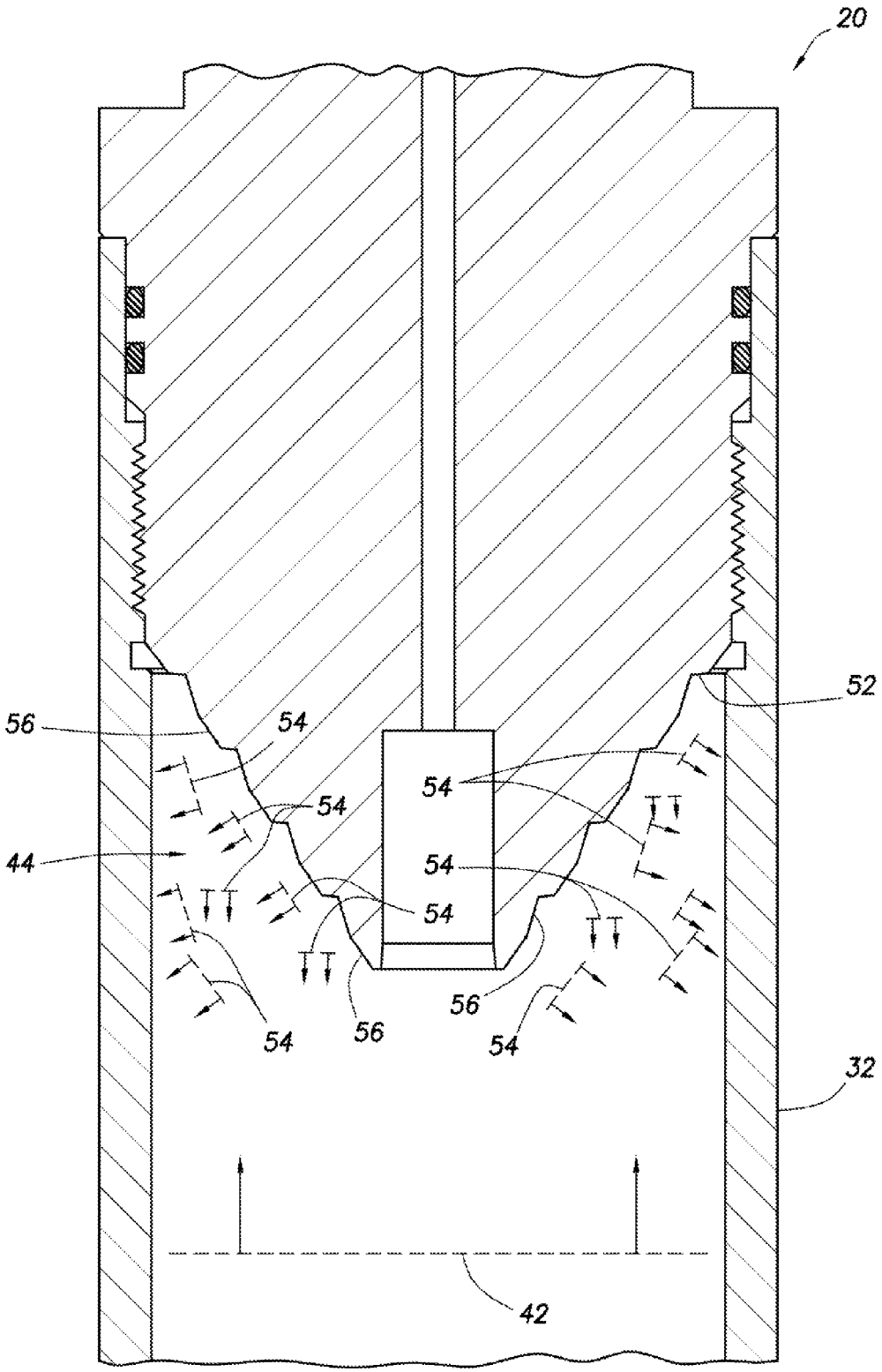

Referring additionally now to FIG. 5, another configuration of the shock mitigating device 44 is representatively illustrated. In this example, the surface 56 of the reflector 52 comprises multiple individual surfaces, instead of a single conical surface, although the surfaces are still in a generally conical arrangement. A shock attenuator 46 may be used with the reflector 52 (similar to the combined attenuator 46 and reflector 52 in the device 44 configuration of FIG. 4), if desired.

The surfaces 56 cause many smaller (as compared to the reflected shock wave in the FIG. 3 configuration) shock waves 54 to be reflected in various directions. Preferably, the reflected shock waves 54 are directed generally outward toward the gun housing 32, and are not reflected directly back in the opposite direction of the shock wave 42. Furthermore, it is preferable that the many reflected shock waves 54 interfere with each other and at least partially cancel or attenuate one another.

For example, the impact of the shock wavefront from the blast can be spread over time to reduce peak amplitudes of shock in the steel tools of the perforating string 12. The various incidence angles can provide a reduction in energy transfer from the fluid to the steel as more of the wave is reflected.

There is a distinction between the objective of reducing the initial response (and peak stress) due to the incoming shock wave, and reducing the multitude of reflections in the fluid or the structure which result in repeated peak stresses over some time.

The reflected waves in the fluid can be dispersed or scattered in timing and direction to reduce reflected waves in the fluid. The angled faces of the steel can also break up the internal reflections of the waves within the steel part. This is in sharp contrast to conventional perforating guns with a uniform flat surface impacted at 90 degrees by an incoming wave, allowing for maximum transmission of energy and peak amplitudes in a steel gun housing.

In practice, exactly which direction the waves are reflected (by the angle(s) on the surface(s) 56) should be carefully considered to avoid creating a local stress problem on the gun housing 32 wall. This is relevant to all of the examples described above.

Thus, it will be appreciated that the shock mitigation device 44 may mitigate shock by reflecting, absorbing, breaking-up, scattering and/or dispersing the shock wave 42.

Figure 6:
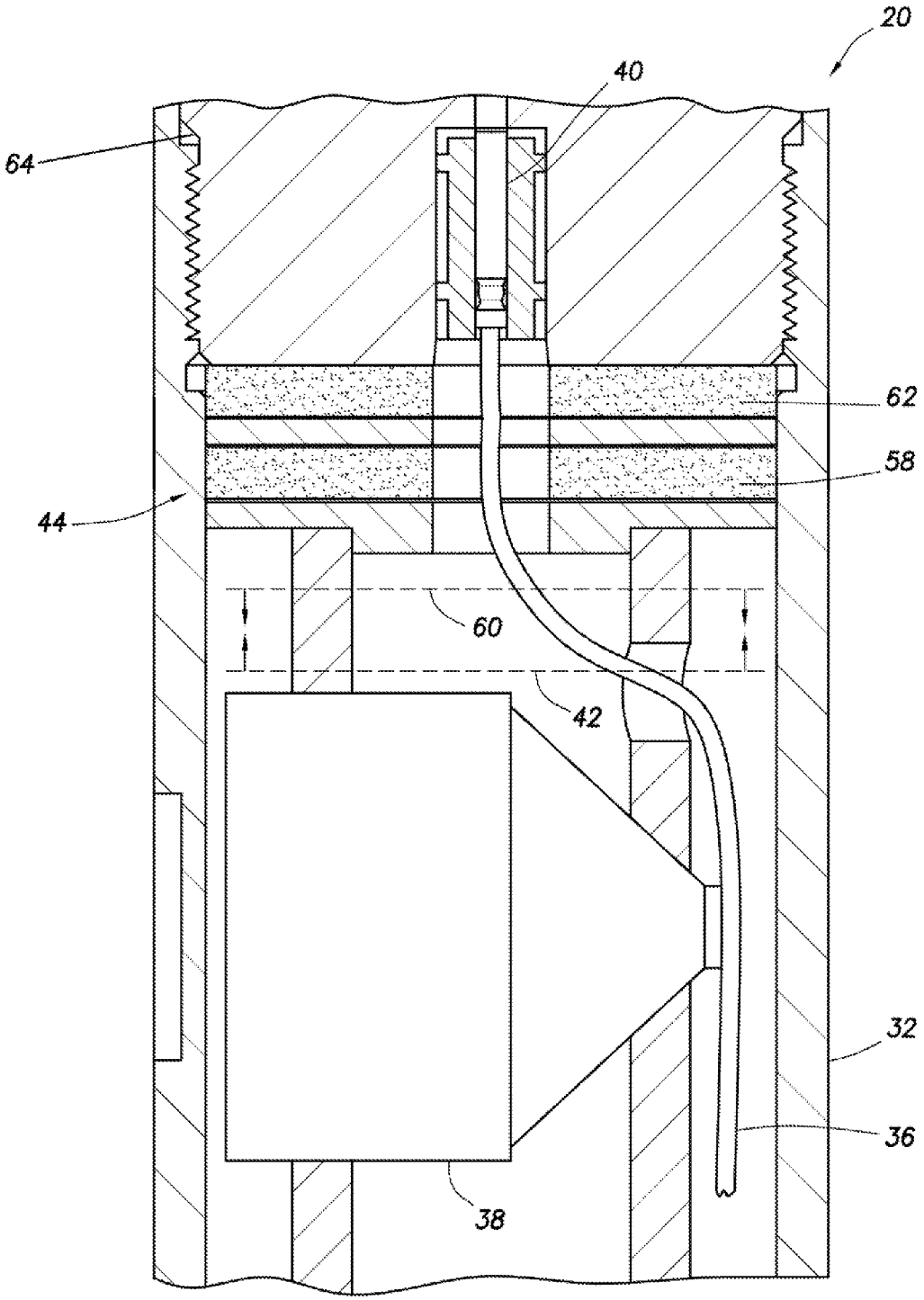

Referring additionally now to FIG. 6, yet another configuration of the shock mitigating device 44 is representatively illustrated. In this example, the device 44 includes a material 58 which produces a shock wave 60 that is oppositely directed relative to the shock wave 42 produced by detonation of the explosive components of the perforating gun 20, and is preferably timed to be at least partially out of phase with the shock wave 42.

The material 58 could be, for example, an explosive sheet material. The material 58 may be detonated in response to detonation of any of the other explosive components (such as, the detonating cord 36, perforating charge 38 or detonation booster 40, etc.). Alternatively, the material 58 could be detonated a certain amount of time before or after the other explosive components are detonated.

Preferably, the shock wave 60 produced by detonation of the material 58 at least partially "cancels" the shock wave 42, thereby attenuating the shock wave. A sum of the shock waves 42, 60 is preferably less than an amplitude of either of the shock waves.

A shock attenuator 46 may be used with the FIG. 6 example. The shock attenuator 46 could include the materials 48, 50 described above, or in other examples, the shock attenuator could include a dispersive media 62 (such as sand or glass beads, etc.) to dissipate shock between a fluid interface and a structure (such as a connector body 64). For example, the dispersive media could be positioned between a steel plate and the connector body 64.

In any of the examples described above, the device 44 can be configured so that it has a desired amount of shock mitigation. For example, the amount of explosive material 58 or the timing of the detonation in the FIG. 6 configuration can be changed as desired to produce the shock wave 60 having certain characteristics. As another example, the compliance, density, thickness, number and resilience of the layers of materials 48, 50 in the configurations of FIGS. 2 & 4 can be varied to produce corresponding variations in shock attenuation.

This feature (the ability to vary the amount of internal shock mitigation) can be used to "tune" the overall perforating string 12, so that shock effects on the perforating string are mitigated. Suitable methods of accomplishing this result are described in International Application serial nos. PCT/US10/61104 (filed 17 Dec. 2010), PCT/US11/34690 (filed 30 Apr. 2011), and PCT/US11/46955 (filed 8 Aug. 2011). The entire disclosures of these prior applications are incorporated herein by this reference.

The examples of the shock mitigating device 44 described above demonstrate that a wide variety of different configurations are possible, while remaining within the scope of this disclosure. Accordingly, the principles of this disclosure are not limited in any manner to the details of the device 44 examples described above or depicted in the drawings.

It may now be fully appreciated that this disclosure provides several advancements to the art of mitigating shock effects in subterranean wells. Various examples of shock mitigating devices 44 described above can effectively prevent or at least reduce transmission of shock to other components of the perforating string 12.

In one aspect, the above disclosure provides to the art a perforating gun 20. In one example, the perforating gun 20 can include at least one explosive component (such as, the detonating cord 36, perforating charge 38 or detonation booster 40, etc.), and a shock mitigation device 44 including a shock reflector 52 which indirectly reflects a shock wave 42 produced by detonation of the explosive component.

The shock mitigation device 44 may close off an end of a gun housing 32 containing the explosive component.

At least one surface 56 on the shock reflector 52 may indirectly reflect the shock wave 42. The surface 56 can reflect the shock wave 42 toward a gun housing 32 containing the explosive component. The surface 56 may be generally conical-shaped.

The surface 56 may comprise multiple surfaces which reflect the shock wave 42 as respective multiple reflected shock waves 54. The reflected shock waves 54 may interfere with each other.

The shock mitigation device 44 can include a shock attenuator 46 which attenuates the shock wave 42. The shock reflector 52 may reflect the attenuated shock wave 42. The shock attenuator 46 may comprise layers of resilient and non-resilient materials 48, 50. Additional examples of resilient structures include mechanical springs, etc. Additional examples of non-resilient materials include crushable structures, such as honeycomb or other celled structure, etc.

The shock attenuator 46 may comprises variations in acoustic impedance. The shock attenuator 46 may comprise a dispersive media 62.

Also described above is a perforating gun 20 which, in one example, can include a gun housing 32, at least one explosive component (such as, the detonating cord 36, perforating charge 38 or detonation booster 40, etc.), and a shock mitigation device 44 in the gun housing 32. The shock mitigation device 44 may include a shock attenuator 46 which attenuates a shock wave 42 produced by detonation of the explosive component.

The shock mitigation device 44 may reflect the attenuated shock wave 42, directly or indirectly. The shock mitigation device 44 may mitigate shock by reflecting, absorbing, breaking-up, scattering and/or dispersing a shock wave 42.

This disclosure also describes a perforating gun 20 which, in one example, includes a gun housing, at least one explosive component (such as, the detonating cord 36, perforating charge 38 or detonation booster 40, etc.), and a shock mitigation device 44 in the gun housing 32, the shock mitigation device 44 including an explosive material 58 which produces a first shock wave 60 that interacts with a second shock wave 42 produced by detonation of the explosive component.

The first shock wave 60 may at least partially counteract or cancel the second shock wave 42. A sum of the first and second shock waves 42, 60 can have an amplitude which is less than that of each of the first and second shock waves 42, 60.

The explosive material 58 may detonate a predetermined amount of time before or after the explosive component detonates. The explosive component and the explosive material 58 may detonate substantially simultaneously.

The first shock wave 60 may be produced in response to impingement of the second shock wave 42 on the shock mitigation device 44. The first shock wave 60 preferably propagates in a direction opposite to a direction of propagation of the second shock wave 42.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A perforating gun, comprising:

at least one explosive component; and a shock mitigation device including a shock reflector which indirectly reflects a shock wave in a fluid within the perforating gun, the shock wave produced by detonation of the explosive component, wherein the shock reflector comprises multiple tiered shock reflecting surfaces having different diameters, wherein the shock reflecting surfaces are generally conical-shaped, wherein the shock reflecting surfaces are convex relative to the explosive component, and wherein at least two of the shock reflecting surfaces have different incidence angles, whereby the shock wave is reflected as respective multiple reflected shock waves in different directions, thereby breaking up the shock wave and reducing an energy transfer from the fluid to an internal surface of the perforating gun.

2. The perforating gun of claim 1, wherein the shock mitigation device closes off an end of a gun housing containing the explosive component.

3. The perforating gun of claim 1, wherein the shock reflector reflects the shock wave toward a gun housing.

4. The perforating gun of claim 1, wherein the respective multiple reflected shock waves interfere with each other.

5. The perforating gun of claim 1, wherein the shock mitigation device comprises a shock attenuator which attenuates the shock wave.

6. The perforating gun of claim 5, wherein the shock reflector reflects the attenuated shock wave.

7. The perforating gun of claim 5, wherein the shock attenuator comprises layers of resilient and non-resilient materials.

8. The perforating gun of claim 5, wherein the shock attenuator comprises variations in acoustic impedance.

9. The perforating gun of claim 5, wherein the shock attenuator comprises a dispersive media.

* * * * *

UNITED STATES PATENT AND TRADEMARK OFFICE

CERTIFICATE OF CORRECTION

PATENT NO. : 9,091,152 B2
APPLICATION NO. : 13/493327
DATED : July 28, 2015
INVENTOR(S) : Rodgers et al.

It is certified that error appears in the above-identified patent and that said Letters Patent is hereby corrected as shown below:

On the Title page of the patent, item (30) the following priority data should be added:

Foreign Application Priority Data:

Aug. 31, 2011 (WO) PCT/US2011/049882

Signed and Sealed this
Twenty-sixth Day of April, 2016

Michelle K. Lee

Michelle K. Lee
*Director of the United States Patent and Trademark Office*